US005420674A

United States Patent [19]

Kobayashi

[11] Patent Number: 5,420,674

[45] Date of Patent: May 30, 1995

[54] OZONE FREE IMAGE RECORDING APPARATUS USING LIQUID PIGMENT

[75] Inventor: Kazuo Kobayashi, Kagamigahara, Japan

[73] Assignee: Brother Kogyo Kabushiki Kaisha, Nagoya, Japan

[21] Appl. No.: 133,320

[22] Filed: Oct. 8, 1993

[30] Foreign Application Priority Data

Oct. 13, 1992 [JP] Japan ..... 4-274313
Feb. 16, 1993 [JP] Japan ..... 5-026859

[51] Int. Cl.[6] ..... G03G 17/00

[52] U.S. Cl. ..... 355/256; 430/115; 430/117

[58] Field of Search ..... 355/210, 256, 257, 258, 355/211, 212; 118/659, 660, 661; 430/117–119, 112–116, 34, 38

[56] References Cited

U.S. PATENT DOCUMENTS

| | | | |
|---|---|---|---|
| 2,357,809 | 11/1940 | Carlson | 355/210 |
| 3,988,060 | 10/1976 | Teumer et al. | 355/257 |
| 4,023,898 | 5/1977 | Ohno et al. | 355/256 |
| 4,259,428 | 3/1981 | Tsuneda | 430/115 |
| 4,357,096 | 11/1982 | Fetterman | 355/257 |
| 4,541,706 | 9/1985 | Kishi | 355/211 X |
| 4,780,389 | 10/1988 | El-Sayed | 430/115 |
| 5,053,823 | 10/1991 | Oh-ishi et al. | 355/256 |
| 5,060,020 | 10/1991 | Sakai | 355/245 |
| 5,151,741 | 9/1992 | Kakutani et al. | 355/257 |
| 5,159,389 | 10/1992 | Minami et al. | 355/211 |
| 5,291,246 | 3/1994 | Tsukamoto | 355/210 |

FOREIGN PATENT DOCUMENTS 0076755 5/1985 Japan .

*Primary Examiner*—Robert B. Beatty
*Attorney, Agent, or Firm*—Oliff & Berridge

[57] ABSTRACT

In an image recording apparatus which does not generate ozone and has a simple structure, a pigment supply device where pigment is dispersed in liquid along with a surface active agent contacts with a layer of semiconductor of a photosensitive drum and the semiconductor layer is selectively exposed according to an image to be recorded by a light source. Then the pigment is attached onto the photosensitive drum, and then transferred and fixed onto an image recording paper as an output image. The surface active agent is oxidized by the light source and separated from the pigment to cause selected pigments from the pigment dispersed liquid to attach to the photosensitive drum.

19 Claims, 5 Drawing Sheets

OZONE FREE IMAGE RECORDING APPARATUS USING LIQUID PIGMENT

BACKGROUND OF THE INVENTION

1. Field of the Invention

The present invention relates to an ozone free image recording apparatus having a simple structure and an image formation method thereby.

2. Description of Related Art

Conventionally, it is well known that a laser printer, an LED printer, an LCD printer, etc. can be used as an image recording apparatus using an electronic photograph process. The conventional image recording apparatus using this electronic photograph process comprises a photosensitive drum, a charge device for charging a surface of the photosensitive drum to a desired potential, an exposure device for exposing the surface of the photosensitive drum charged by the charge device and for forming an electrostatic latent image thereon, a developing device for developing the electrostatic latent image formed on the photosensitive drum into a visible image by the developing device, a transfer device for transferring the image developed on the photosensitive drum to an image recording paper which is an image supporting medium, a fixing device for fixing the image transferred on the image recording paper, a static charge removing device for removing a static charge on the photosensitive drum, and a cleaning device for cleaning the developer remaining on the photosensitive drum. A prototype of such an image recording apparatus using the electronic photograph process is well-known in U.S. Pat. No. 2,357,809. Various types of image recording apparatuses to which the above basic apparatus is applied have been invented by the same applicant, for example, such an apparatus is shown in U.S. Pat. No. 5,060,020.

However, as the above-mentioned image recording apparatus uses the electronic photograph process, it needs a complex process such as a charging process, an electrostatic latent image forming process, a developing process, a transferring process, a fixing process, a removing process of a static charge and a cleaning process of a residual developer. Moreover, in recent years, there is a problem in that the ozone which is generated by the charging process may have harmful effects on the office environment. Therefore, there is a need for an ozone free image recording apparatus.

SUMMARY OF THE INVENTION

An object of the present invention is to provide an image recording apparatus which has a simple process where no ozone is generated. In order to achieve the above object, the image recording apparatus of the present invention comprises a pigment dispersed liquid in which the pigment is dispersed by using a surface active agent or a surface treating agent, the apparatus having a photosensitive member on which a semiconductor layer is provided, and a light source which selectively exposes a part of the apparatus where the photosensitive member contacts with the pigment dispersed liquid.

In the image recording apparatus thus constructed, the photosensitive member, such as a photosensitive drum or a photosensitive sheet, is put into contact with the pigment dispersed liquid, in which the pigment is dispersed, by using the surface active agent or the surface treating agent, and the part of the apparatus where the photosensitive member contacts with the pigment dispersed liquid is selectively exposed, according to the image pattern, by the light source. Thereby, the pigment is attached to the exposed part or unexposed part on the photosensitive member according to the image pattern.

As mentioned above, according to the present invention, the image formation, which was performed in the conventional image recording apparatus by three processes, such as a charging process, an electrostatic latent image forming process by an exposure, and a developing process by a developer, is performed using only one process, so that the image recording apparatus has a very simple structure. And further, as the charging process which causes the generation of ozone is not used in the image recording apparatus of the present invention, the office environment can be safely guarded from exposure to ozone.

BRIEF DESCRIPTION OF THE DRAWINGS

A preferred embodiment of the present invention will be described in detail with reference to the following figures wherein.

DETAILED DESCRIPTION OF THE PREFERRED EMBODIMENT

A first embodiment of the present invention will now be described with reference to FIGS. 1 through 3.

Figure 1:
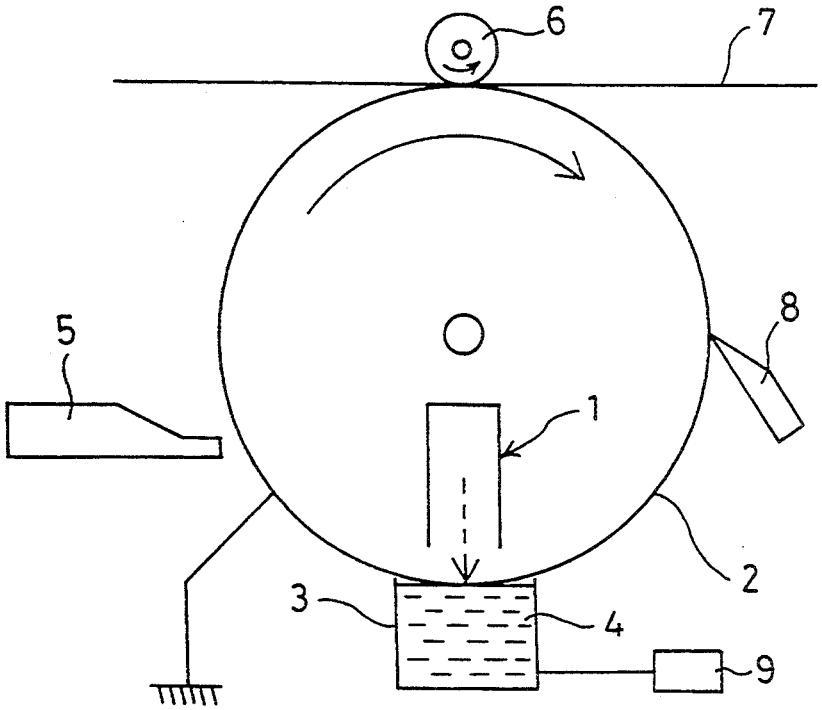
FIG. 1 is a schematic cross-sectional view showing a construction of an image recording apparatus of a first embodiment of the present invention.
Figure 2:
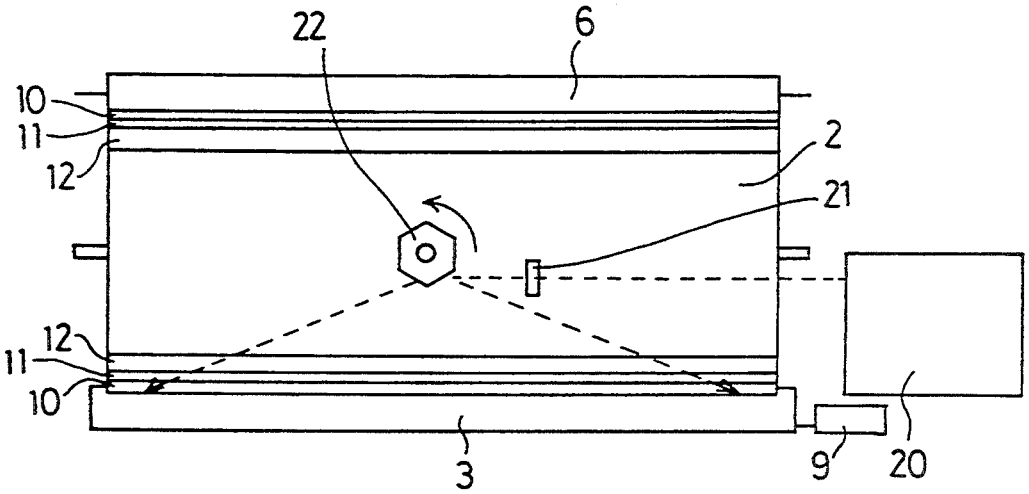
FIG. 2 is a longitudinal sectional view of the image recording apparatus shown in FIG. 1.

FIGS. 1 and 2 show a construction of an optical printer which is a first embodiment of the present invention, in which an image forming process by exposure, a transfer and fixing process, and a cleaning process of the residual pigment are executed.

Figure 3:
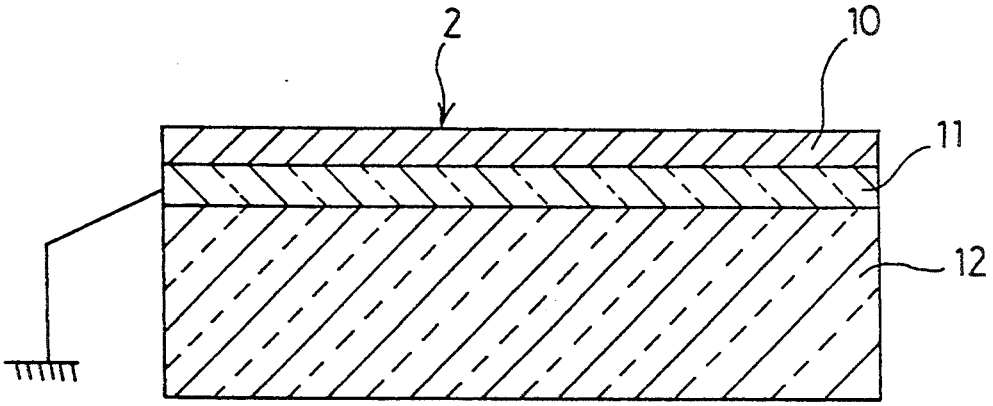
FIG. 3 is a partial cross-sectional view of a photosensitive drum of the image recording apparatus shown in FIG. 1.

This optical printer comprises a light source 1 including a $N_2$ laser 20, an acoustic optical modulator 21, and a polygon mirror 22; a photosensitive drum 2 having a layered structure as shown in FIG. 3, that is, having a layer 10 of zinc oxide (ZnO) which is n-type semiconductor, a layer of a grounded transparent electrode 11, Indium Tin Oxide (ITO) is often used as the transparent electrode, and a layer of glass substrate 12; a pigment cell 3 which is located to receive light from light source 1, in which pigment dispersed liquid 4 is filled so that the surface of the liquid 4 may contact with the photosensitive drum 2, and the pigment dispersed liquid 4 is always replenished by the pigment dispersed liquid replenishment device 9; an air outlet 5 for drying the photosensitive drum 2; a pressure roller 6 for transferring and fixing an image on a image recording paper 7; and a cleaning blade 8 for cleaning any pigment remaining on the photosensitive drum 2 after the image is transferred to the image recording paper 7.

The pigment dispersed liquid 4 is obtained as follows. First, FPEG(11-ferrocenyl undecyl tridecaethylene glycol ether) as a surface active agent and lithium bromide (LiBr) as an electrolyte are mixed in an ion exchange water so that each density becomes 2.0 milli mol (Mm) and 0.1 mol (M). Then, a carbon black, which is one of a hydrofobical organic pigment, is added to the above-mentioned solution so that its density becomes 7.0 mM and it is stirred for several hours. Then a supersonic irradiation is applied to this solution for 30 minutes. The solution is further stirred for several hours. After that, it is left for 24 hours at room temperature (about 25° C.). After 24 hours have passed, a clear layer at the top of the solution is scooped up, and the pigment dispersed liquid 4 is thus obtained.

As the surface active agent, Polyoxyethylene Alkyl Ether, Polyethylene Glycol Fatty Acid Ester, Polyoxyethylene Alkylamine, etc. can be used instead of FPEG.

Moreover, as the electrolyte, Lithium Sulfate (Li2-SO4), Lithium Perchlorate (LiCIO4), Lithium Chloride (LiCl), Lithium Iodide (LiI), Sodium Sulfate (Na2SO4), Sodium Perchlorate (NaCIO4), Sodium Bromide (NaBr), Sodium Chloride (NaCl), Sodium Iodide (NaI), etc. can be used instead of Lithium Bromide (LiBr).

Moreover, as the pigment, various kind of hydrophobic organic pigments such as Diazo Yellow, Diazo Orange, Phthalocyanine Blue, Phthalocyanine Green, Rose Lake, etc. can be used.

Next, the printing process of the optical printer of the present invention is explained with reference to FIGS. 1 and 2. An ultraviolet beam whose wave length is 337 nano-meters, (nm) which is irradiated from N2 laser 20, is modulated with acoustic optical modulator 21 based on an image signal sent from a computer (not shown) and is scanned by the polygon mirror 22. Then, an image pattern is exposed on the zinc oxide layer 10 from the inside of the photosensitive drum 2 through the glass substrate 12 and the transparent electrode 11. An excimer laser can be used instead of the N2 laser 20. When the ultraviolet beam, whose wave length is shorter than 385 nm, which corresponds to a band gap of the zinc oxide layer 10 as the n-type semiconductor, is irradiated to the zinc oxide layer 10, a positive hole is made on a valence band and an electron is made on a conduction band by a light excitation. Shown in an energy level, the zinc oxide 10 is in a anodic polarized condition relative to the pigment dispersed liquid 4, so that the electron moves to the ground through the transparent electrode 11 and the positive hole moves to the surface of the zinc oxide layer 10 of the photosensitive drum 2. The positive hole has a strong oxidation power, so that it oxidizes FPEG as the surface active agent included in the pigment dispersed liquid 4, which is located in contact with the surface of the zinc oxide layer 10. The oxidized FPEG loses its function as the surface active agent and separates from the surface of the organic pigment. Therefore, the hydrofobical organic pigment piles up on the surface of the zinc oxide layer 10 and the image is formed by the pigment on the photosensitive drum 2. After any extra moisture on the surface of the photosensitive drum 2 is dried by air outlet 5, the image according to the piled pigment is transferred and fixed on the image recording paper 7 by the pressure roller 6, and then the image recorded paper 7 is discharged. The pigment remaining on the photosensitive drum 2 after the image is transferred is removed by the cleaning blade 8. The operation of the optical printer can be performed by repeating the above mentioned process.

A second embodiment of the present invention will now be described with reference to FIGS. 4 through 6.

Figure 4:
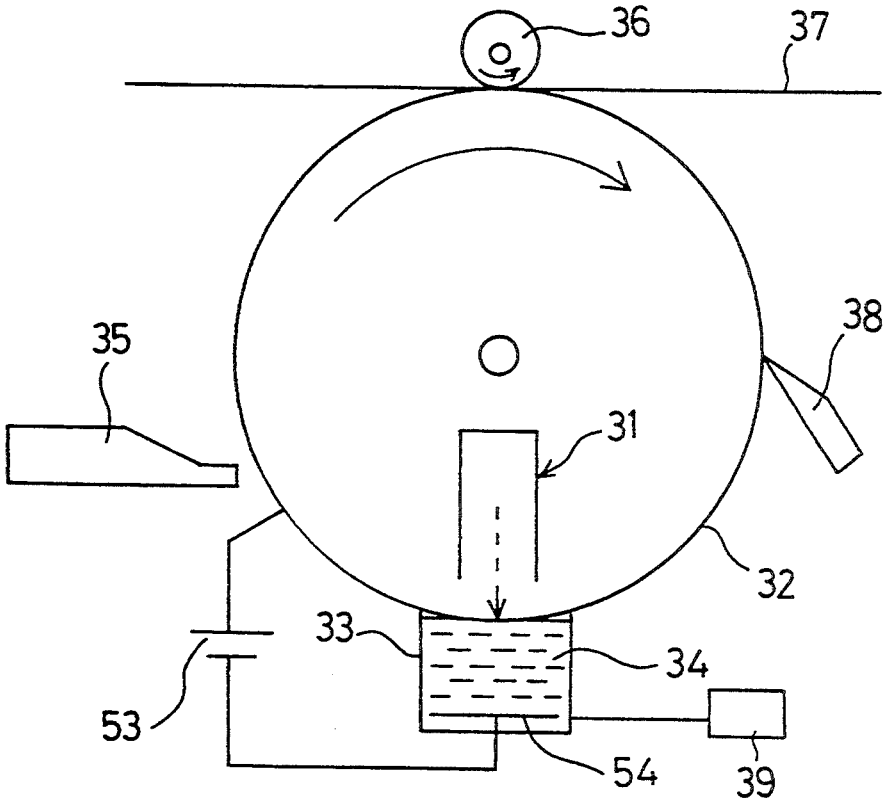
FIG. 4 is a schematic cross-sectional view showing a construction of an image recording apparatus of a second embodiment of the present invention.
Figure 5:
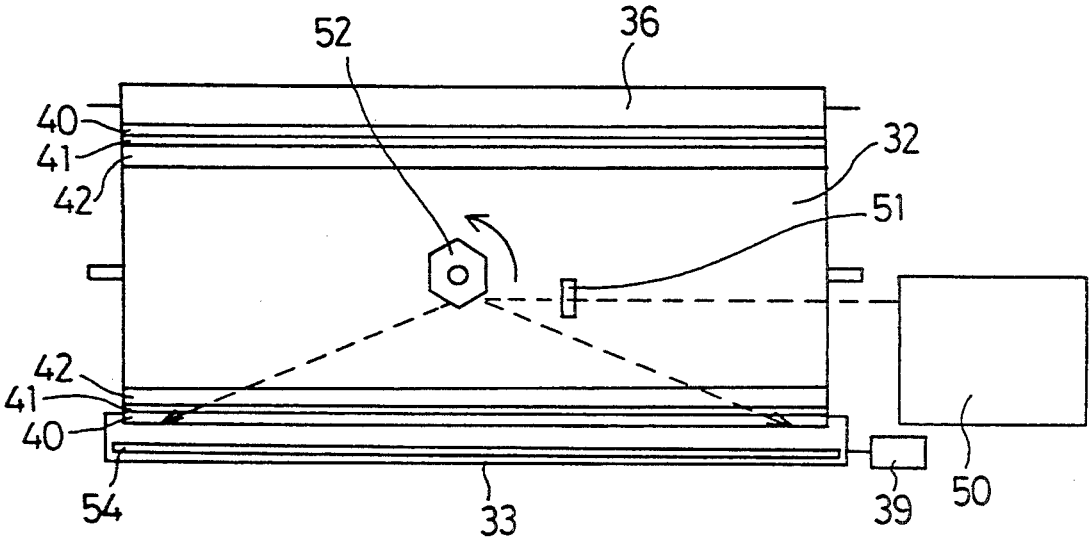
FIG. 5 is a longitudinal sectional view of the image recording apparatus shown in FIG. 4.

FIGS. 4 and 5 show a construction of an optical printer which is a second embodiment of the present invention, in which an image forming process by exposure, a transfer and fixing process, and a cleaning process of the residual pigment are executed.

Figure 6:
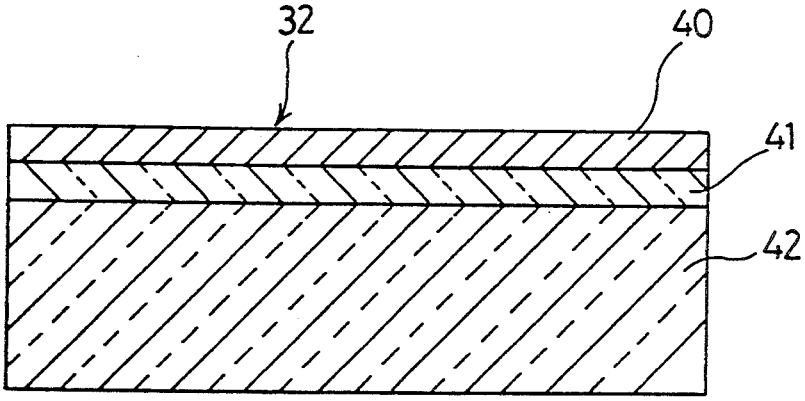
FIG. 6 is a partial cross-sectional view of a photosensitive drum of the image recording apparatus shown in FIG. 4.

This optical printer comprises a light source 31 including an N2 laser 50, an acoustic optical modulator 51, and a polygon mirror 52; a photosensitive drum 32 having a layered structure as shown in FIG. 6, that is, having a layer of titanium oxide (TiO2) 40 which is n-type semiconductor, a layer of a transparent electrode (ITO) 41, and a layer of glass substrate 42; a pigment cell 33 which is located to contact light from light source 31, in which pigment dispersed liquid 34 is filled so that the surface of the liquid 34 may contact with the photosensitive drum 32, and the pigment dispersed liquid 34 is always replenished by the pigment dispersed liquid replenishment device 39; a platinum cover electrode 54 provided in the pigment cell 33; a constant voltage power supply 53 for applying a voltage between the transparent electrode 41 and the platinum cover electrode 54; an air outlet 35 for drying the photosensitive drum 32; a pressure roller 36 for transferring and fixing an image on a image recording paper 37; and a cleaning blade 38 for cleaning any pigment remaining on the photosensitive drum 32 after the image is transferred to the image recording paper 37.

The photosensitive drum 32 is polarized to the anodic side by applying the voltage of 5 V from the constant voltage power supply 53 between the transparent electrode 41 of the photosensitive drum 32 and the platinum cover electrode 54.

The pigment dispersed liquid 34 is obtained as follows. First, FPEG(11-ferrocenyl undecyl tridecaethylene glycol ether) as a surface active agent and lithium bromide (LiBr) as an electrolyte are mixed in an ion exchange water so that each density becomes 2.0 milli mol (mM) and 0.1 mol (M). Then, a carbon black, which is one of a hydrofobical organic pigment, is added to the above-mentioned solution so that its density becomes 7.0 mM and it is stirred for several hours. Then a supersonic irradiation is applied to this solution for 30 minutes. The solution is further stirred for several hours. After that, it is left for 24 hours at room temperature (about 25° C.). After 24 hours have passed, a clear layer at the top of the solution is scooped up, and the pigment dispersed liquid 4 is thus obtained.

As the surface active agent, Polyoxyethylene Alkyl Ether, Polyethylene Glycol Fatty Acid Ester, Polyoxyethylene Alkylamine, etc. can be used, instead of FPEG.

Moreover, as the electrolyte, Lithium Sulfate (Li2-SO4), Lithium Perchlorate (LiCIO4), Lithium Chloride (LiCl), Lithium Iodide (LiI), Sodium Sulfate (Na2SO4), Sodium Perchlorate (NaCIO4), Sodium Bromide (NaBr), Sodium Chloride (NaCl), Sodium Iodide (NaI), etc. can be used, instead of Lithium Bromide (LiBr).

Moreover, as the pigment, various kind of hydrophobic organic pigments such as Diazo Yellow, Diazo Orange, Phthalocyanine Blue, Phthalocyanine Green, Rose Lake, etc. can be used.

Next, the printing process of the optical printer of the present invention is explained with reference to FIGS. 4 and 5. An ultraviolet beam whose wave length is 337 nano-meters, (nm) which is irradiated from N2 laser 50, is modulated with acoustic optical modulator 51 based on an image signal sent from a computer (not shown) and is scanned by the polygon mirror 52. Then, an image pattern is exposed on the titanium oxide layer 40 from the inside of the photosensitive drum 32 through the glass substrate 42 and the transparent electrode 41. An excimer laser can be used instead of the N2 laser 50. When the ultraviolet beam, whose wave length is shorter than 400 nm, which corresponds to a band gap of the titanium oxide 40 as the n-type semiconductor, is irradiated to the titanium oxide 40, a positive hole is made on a valence band and an electron is made on a conduction band by a light excitation. Shown in an energy level, the titanium oxide layer 40 is in a anodic polarized condition relative to the pigment dispersed liquid 34, because of the voltage added to the transparent electrode 41 and the platinum cover electrode 54 in the pigment dispersed liquid 34, so that the electron moves to the platinum cover electrode 54 through the transparent electrode 41 and the positive hole moves to the surface of the titanium oxide layer 40 of the photosensitive drum 32. The positive hole has a strong oxidation power, so that it oxidizes FPEG as the surface active agent included in the pigment dispersed liquid 34, which is located in contact with the surface of the titanium oxide layer 40. The oxidized FPEG loses its function as the surface active agent and separates from the surface of the organic pigment. Therefore, the hydrofobical organic pigment piles up on the surface of the titanium oxide layer 40 and the image is formed by the pigment on the photosensitive drum 32. After any extra moisture on the surface of the photosensitive drum 32 is dried by air outlet 35, the image according to the piled pigment is transferred and fixed on the image recording paper 37 by the pressure roller 36, and then the image recorded paper 37 is discharged. The pigment remaining on the photosensitive drum 32 after the image is transferred is removed by the cleaning blade 38. The operation of the optical printer can be performed by repeating the above mentioned process.

A platinum electrode, a gold electrode, a stainless electrode, etc. can be used instead of the above-mentioned platinum cover electrode 54.

A third embodiment of the present invention will now be described with reference to FIGS. 7 through 9.

Figure 7:
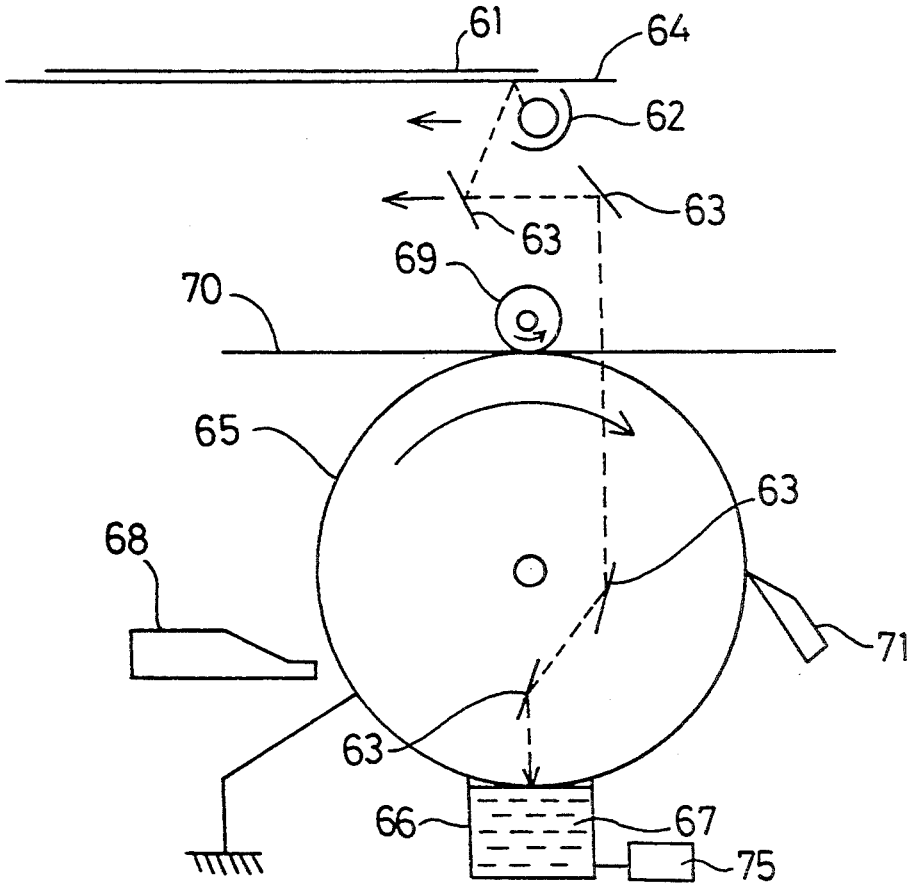
FIG. 7 is a schematic cross-sectional view showing a construction of an image recording apparatus of a third embodiment of the present invention.
Figure 8:
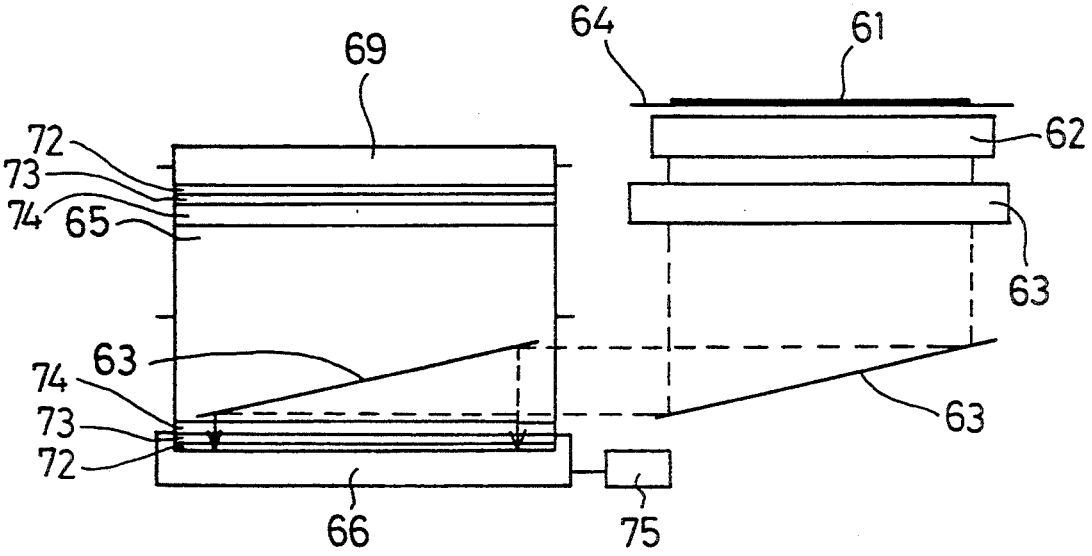
FIG. 8 is a longitudinal sectional view of the image recording apparatus shown in FIG. 7.

FIGS. 7 and 8 show a construction of a copy machine which is a third embodiment of the present invention, in which an image forming process by exposure, a transfer and fixing process, and a cleaning process of the residual pigment are executed.

Figure 9:
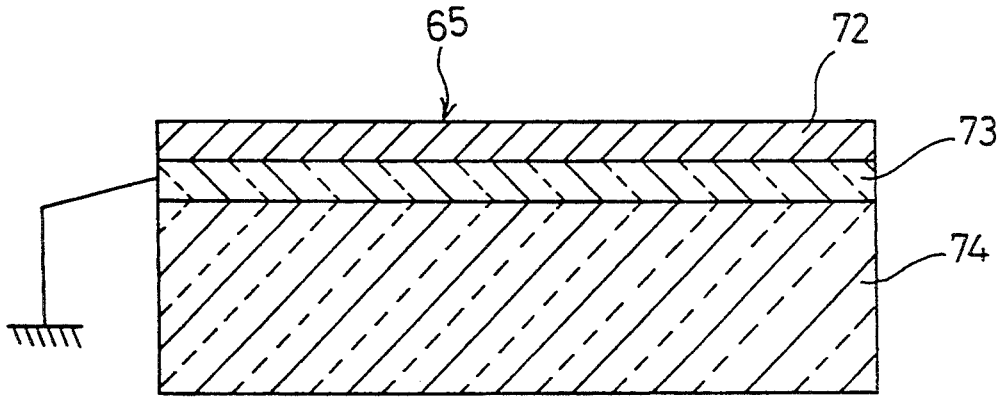
FIG. 9 is a partial cross-sectional view of a photosensitive drum of the image recording apparatus shown in FIG. 7.

This copying machine comprises a contact glass 64 for putting an original 61 thereon; a light source 62 using a mercury xenon lamp; an optical system 63 constructed from a plurality of mirrors; a photosensitive drum 65 having a layered structure as shown in FIG. 9, that is, having a layer of zinc oxide (ZnO) 72 which is n-type semiconductor, a layer of a grounded transparent electrode (ITO) 73, and a layer of glass substrate 74; a pigment cell 66 which is located to contact light dispersed from light source 62 through the optical system 63, in which pigment dispersed liquid 67 is filled so that the surface of the liquid 67 may contact with the photosensitive drum 65, and the pigment dispersed liquid 67 is always replenished by the pigment dispersed liquid replenishment device 75; an air outlet 68 for drying the photosensitive drum 65; a pressure roller 69 for transferring and fixing an image on a image recording paper 70; and a cleaning blade 71 for cleaning any pigment remaining on the photosensitive drum 65 after the image is transferred to the image recording paper 70.

The pigment dispersed liquid 67 is obtained as follows. First, FPEG(11-ferrocenyl undecyl tridecaethylene glycol ether) as a surface active agent and lithium bromide (LiBr) as an electrolyte are mixed in an ion exchange water so that each density becomes 2.0 milli mol (mM) and 0.1 mol (M). Then, a carbon black, which is one of a hydrofobical organic pigment, is added to the above-mentioned solution so that its density becomes 7.0 mM and it is stirred for several hours. Then a supersonic irradiation is applied to this solution for 30 minutes. The solution is further stirred for several hours. After that, it is left for 24 hours at room temperature (about 25° C.). After 24 hours have passed, a clear layer at the top of the solution is scooped up, and the pigment dispersed liquid 67 is thus obtained.

As the surface active agent, Polyoxyethylene Alkyl Ether, Polyethylene Glycol Fatty Acid Ester, Polyoxyethylene Alkylamine, etc. can be used, instead of FPEG.

Moreover, as the electrolyte, Lithium Sulfate (Li2SO4), Lithium Perchlorate (LiCIO4), Lithium Chloride (LiCl), Lithium Iodide (LiI), Sodium Sulfate (Na2SO4), Sodium Perchlorate (NaCIO4), Sodium Bromide (NaBr), Sodium Chloride (NaCl), Sodium Iodide (NaI), etc. can be used, instead of Lithium Bromide (LiBr).

Moreover, as the pigment, various kind of hydrophobic organic pigments such as Diazo Yellow, Diazo Orange, Phthalocyanine Blue, Phthalocyanine Green, Rose Lake, etc. can be used.

Next, the printing process of the copy machine of the present invention is explained with reference to FIGS. 7 and 8.

A reflection light obtained by scanning the original 61 put on the contact glass 64 with the light source 62, through the optical system 63, is exposed as an optical input image on the zinc oxide layer 72 from the inside of the photosensitive drum 65 through the glass substrate 74 and the transparent electrode 73. When the ultraviolet beam, whose wave length is shorter than 385 nm, which corresponds to a band gap of the zinc oxide 72 as the n-type semiconductor which is included in the reflection light, is irradiated to the zinc oxide 72, a positive hole is made on a valence band and an electron is made on a conduction band by a light excitation. Shown in an energy level, the zinc oxide 72 is in a anodic polarized condition against the pigment dispersed liquid 67, so that the electron moves to the ground through the transparent electrode 73 and the positive hole moves to the surface of the zinc oxide layer 72 of the photosensitive drum 65. The positive hole has a strong oxidation power, so that it oxidizes FPEG as the surface active agent included in the pigment dispersed liquid 67 which is located in contact with the surface of the zinc oxide 72. The oxidized FPEG loses the function as the surface active agent and separates from the surface of the organic pigment. Therefore, the hydrofobical organic pigment piles up on the surface of the zinc oxide layer 72 and the image by the pigment is formed on the photosensitive drum 65. After any extra moisture on the surface of the photosensitive drum 65 is dried by the air outlet 68, the image according to the piled pigment is transferred and fixed on the image recording paper 70 by the pressure roller 69, and then the image recorded paper 70 is discharged. The pigment remaining on the photosensitive drum 65 after the image is transferred is removed by the cleaning blade 71. The operation of the copy machine can be performed by repeating the above mentioned process.

An electrode can be installed in the pigment cell 66, as shown in the above-mentioned second embodiment, in order to place the photosensitive drum 65 in an anodic polarized condition relative to pigment dispersed liquid 67.

Moreover, a halogen lamp can be used as the light source 62.

It is to be understood that the invention is not restricted to the particular forms shown in the foregoing embodiments. Various modifications and alterations can be added thereto without departing from the scope and spirit of the invention encompassed by the appended claims.

Figure 10:
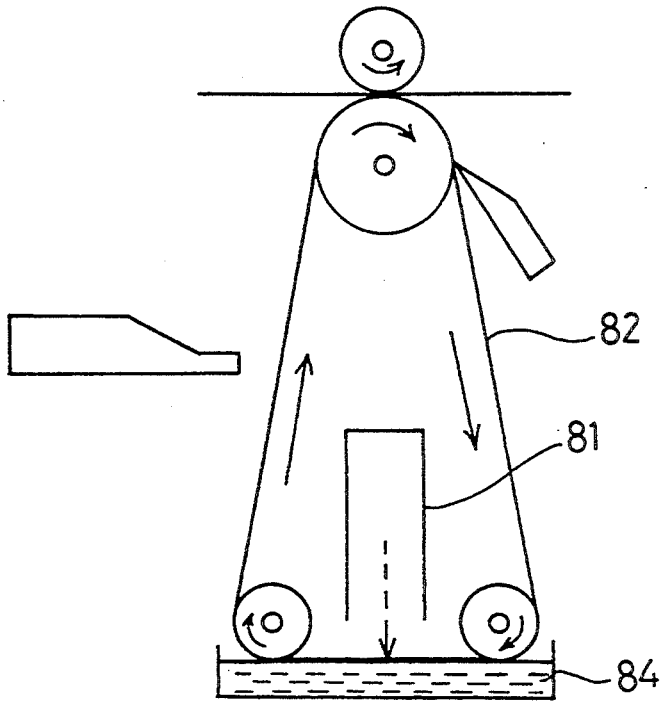
FIG. 10 shows a construction of an image recording apparatus of a forth embodiment of the present invention.

For instance, in each embodiment mentioned above, a drum type photosensitive member is used. However, as shown in FIG. 10, the device comprising an exposure device 81, a photosensitive sheet 82, and a pigment dispersed liquid 84, can be utilized.

Moreover, in each embodiment mentioned above, the pressure transfer method is used to transfer the image formed by the pigment to the image recording paper. However, the image can instead be transferred electrostatically to the image recording paper. Some fixing processes, such as a thermal fixing process or pressure fixing process, would then be used after the transfer process.

Further, in each embodiment mentioned above, the pigment is attached on the exposed part of the photosensitive drum. However it is possible to attach the pigment on the non-exposed part of the photosensitive drum.

Furthermore, in each embodiment mentioned above, the pigment is dispersed in the pigment dispersed liquid by using a surface active agent. However, even if the surface treating agent is used instead of the surface active agent, a similar effect can be obtained i.e. the surface treating agent will be oxidized by the exposure device.

What is claimed is:

1. An image recording apparatus comprising:

photosensitive means having a first surface, the first surface having a semiconductor layer provided thereon;

pigment supplying means for supplying a pigment dispersed liquid in which pigments are dispersed including an electro-conductive electrolyte and one of a surface active agent and a surface treating agent, said pigment supplying means being arranged so that the pigment dispersed liquid comes into contact with said photosensitive means; and exposure means for selectively exposing the semiconductor layer based on an image to be recorded, in order to excite the semiconductor layer, and to oxidize one of the surface active agent and the surface treating agent separating the one of the surface active agent and the surface treating agent from the pigments in the pigment dispersed liquid causing selected pigments from the pigment dispersed liquid to attach onto the first surface of the photosensitive means.

2. The image recording apparatus according to claim 1, wherein the semiconductor layer being exposed by said exposure means is located between said exposure means and said pigment supplying means.

3. The image recording apparatus according to claim 1, wherein said photosensitive means at least includes a layer of titanium oxide.

4. The image recording apparatus according to claim 1, wherein said photosensitive means at least includes a layer of zinc oxide.

5. The image recording apparatus according to claim 1, wherein said photosensitive means further includes a transparent electrode and a glass substrate, said glass substrate being arranged on a second surface of said photosensitive means.

6. The image recording apparatus according to claim 1, wherein the surface active agent is 11-ferrocenyl undecyl tridecaethylene glycol ether (FPEG).

7. The image recording apparatus according to claim 1, wherein said electrolyte is Lithium Bromide (LiBr).

8. The image recording apparatus according to claim 1, wherein the electrolyte included in said pigment supplying means is selected from Lithium Sulfate (Li2-SO4), Lithium Perchlorate (LiCIO4), Lithium Chloride (LiCl), Lithium Iodide (LiI), Sodium Sulfate (Na2SO4), Sodium Perchlorate (NaCIO4), Sodium Bromide (NaBr), Sodium Chloride (NaCl) and Sodium Iodide (NaI).

9. The image recording apparatus according to claim 1, wherein the surface active agent is selected from Polyoxyethylene Alkyl Ether, Polyethylene Glycol Fatty Acid Ester and Polyoxyethylene Alkylamine.

10. The image recording apparatus according to claim 1, wherein said exposure means includes a N2 laser, an acoustic optical modulator, and a polygon mirror.

11. The image recording apparatus according to claim 1, wherein said exposure means includes a light source with a mercury xenon lamp and an optical system constructed by a plurality of mirrors.

12. The image recording apparatus according to claim 1, further comprising:

drying means for drying an image formed by the pigment on said photosensitive means;

recording paper feeding means for feeding a recording paper on which an image is recorded; and image transferring means for transferring the dried image onto the recording paper.

13. The image recording apparatus according to claim 1, further comprising an electrode provided in the pigment dispersed liquid and a constant voltage power supply connected to the electrode and to the photosensitive means to place the photosensitive means in an anodic polarized condition relative to pigment dispersed liquid.

14. The image recording apparatus according to claim 1, wherein said photosensitive means is a photosensitive drum.

15. The image recording apparatus according to claim 1, wherein said photosensitive means is a photosensitive belt.

16. A method of recording an image, comprising the steps of:

exposing a semiconductor layer disposed on a photosensitive means according to image information to be recorded, thereby exciting the semiconductor layer;

contacting the excited semiconductor layer with a pigment dispersed liquid, the pigment dispersed liquid including a surface active agent and an electro-conductive electrolyte;

oxidizing the surface active agent to separate the surface active agent from pigments in the pigment dispersed liquid;

attaching selected pigments from the pigment dispersed liquid onto a surface of the photosensitive means; and transferring and fixing the pigments attached on the photosensitive means onto an image recording paper.

17. The method as claimed in claim 16, further comprising the step of locating the semiconductor layer being exposed between an exposure means and a pigment supplying means.

18. The method as claimed in claim 16, further comprising the step of drying the image formed by the pigments on the surface of the photosensitive means, and removing any pigments remaining on the surface of the photosensitive means.

19. The method as claimed in claim 16, further comprising the step of applying a voltage between a transparent electrode connected to the semiconductor layer and an electrode placed in the pigment dispersed liquid to place the semiconductor layer in an anodic polarized condition relative to the pigment dispersed liquid.

* * * * *